US005716717A

United States Patent [19]

Yeung et al.

[11] Patent Number: 5,716,717

[45] Date of Patent: Feb. 10, 1998

[54] WALLCOVERING MATERIALS INCLUDING NOVEL AQUEOUS POLYMER EMULSIONS USEFUL AS PREPASTE ADHESIVES

[75] Inventors: Dominic Wai-Kwing Yeung; Richard Edward Rice, both of Mississauga, Canada

[73] Assignee: Rhone-Poulenc Inc., Cranbury, N.J.

[21] Appl. No.: 852,793

[22] Filed: May 7, 1997

Related U.S. Application Data

[63] Continuation of Ser. No. 520,459, Aug. 29, 1995, abandoned.

[51] Int. Cl.[6] ..... B32B 23/08

[52] U.S. Cl. ..... 428/511; 428/904.4

[58] Field of Search ..... 428/511, 904.4

[56] References Cited

U.S. PATENT DOCUMENTS

| | | | |
|---|---|---|---|
| 3,696,065 | 10/1972 | Hoffman | 260/17.4 |
| 4,138,381 | 2/1979 | Chang et al. | 260/29.6 |
| 4,384,096 | 5/1983 | Sonnabend | 526/313 |
| 4,421,902 | 12/1983 | Chang et al. | 526/317 |
| 4,639,395 | 1/1987 | Clarke et al. | 428/341 |
| 4,741,790 | 5/1988 | Hawe et al. | 156/71 |
| 5,387,641 | 2/1995 | Yeung et al. | 524/557 |

FOREIGN PATENT DOCUMENTS

| | | | |
|---|---|---|---|
| 1 304 185 | 6/1992 | Canada . | |
| 0 214 760 | 3/1987 | European Pat. Off. | C08F 246/00 |
| 2 054 628 | 2/1981 | United Kingdom . | |

OTHER PUBLICATIONS

Alkali–Swellable and Alkali–Soluble Thickner Technology Gregory D. Shay, pp. 457–494, Desoto, Inc. Administrative and Research Center, 1700 South Mount Prospect Road, Des Plaines, IL 60017, Jan. 31, 1989.

*Primary Examiner*—Helen Lee
*Attorney, Agent, or Firm*—Andrew M. Solomon

[57] ABSTRACT

A wallcovering material comprising a substrate having a water remoistenable adhesive on at least one of its surfaces, said adhesive comprising a composition which is a mixture of:

(1) an aqueous emulsion including an acidic polymer which is capable of swelling when in contact with an alkaline material; and (2) an alkaline material;

wherein said composition has a viscosity of less than about 10000 cps at 25° C. and wherein said composition provides adhesive properties is provided.

20 Claims, No Drawings

WALLCOVERING MATERIALS INCLUDING NOVEL AQUEOUS POLYMER EMULSIONS USEFUL AS PREPASTE ADHESIVES

This application is a continuation of application Ser. No. 08/520,459, filed Aug. 29, 1995, now abandoned.

BACKGROUND OF THE INVENTION

1. Field of the Invention

The present invention relates to novel compositions including aqueous polymer emulsions which are preferably suited for use as wallcovering prepaste adhesives. More specifically, the invention comprises a composition which includes an alkali-swellable neutralized acidic aqueous emulsion which has adhesive properties and may be coated as a unitary layer on a substrate. Particularly preferred emulsions include a polymer wherein at least a portion of the polymer contains one or more carboxylic acid functional groups.

2. Technology Description

A number of materials have been proposed for wallcovering paste materials, and particularly for wallpaper prepaste adhesives. A wallpaper prepaste adhesive is a material which is applied to one side of the wallpaper substrate and then is dried on the substrate. To adhere the paper to a wall, the substrate side with the prepaste adhesive, or more commonly, the entire wallpaper sheet is moistened, typically with water, to cause the adhesive material to swell. The adhesive side is applied to the surface to be covered. An alternative method of applying wallpaper to a surface is to use a "brush on" adhesive which is applied to an uncoated surface of the paper just prior to application of the paper to the wall. While both methods for applying wallpaper to a wall are used, the wallpaper prepaste method is far more common.

Known prepaste adhesives for wallcoverings include starch based materials, modified cellulose materials, alkaline-soluble oil-in-water (O/W) emulsion materials and cross-linked acrylamide-sodium acrylate materials in a water-in-oil (W/O) emulsion. In selecting a prepaste adhesives, the material selected should possess the following attributes: can be applied in one pass, is environmentally safe, is cost effective, is easy to handle, is non-toxic, demonstrates good paste properties and is compatible with commercially available coating machines. Despite the success of the above materials, none can satisfy all of the above criteria.

A representative example of a starch based adhesives is described in U.S. Pat. No. 3,696,065. Starch adhesives are typically applied to wallcoverings in either powder or aqueous form. These materials can be environmentally deleterious as they can produce dust upon application to the substrate and when applying the covering to a surface. Further, starch based adhesives are not necessarily heat stable and as such are limited in their use. For example, they cannot be used in applications which involve hot embossing procedures. U.S. Pat. No. 3,696,065 specifically discloses the addition of a small amount of a vinylpyrrolidone/vinyl acetate solid copolymer to the starch to improve its adhesiveness.

A representative example of a modified cellulose based adhesive is described in U.K. Published Application No. 2,054,628. Modified cellulose adhesives are typically applied to wallcoverings in either powder or aqueous form. These materials can be environmentally deleterious as they can produce dust upon application to the substrate and when applying the covering to a surface. Further, modified cellulose based adhesives are not necessarily heat stable and as such are limited in their use. For example, they cannot be used in applications which involve hot embossing procedures. These materials often do not provide as much adhesion as desired.

A representative example of a cross-linked acrylamide-sodium acrylate polymer material in a water in oil emulsion is described in Canadian Patent No. 1,304,185. The adhesive polymeric materials are coated onto a substrate in a mineral spirit solvent. While such materials have gained wide commercial acceptance, they contain an organic solvent, which causes the volatile organic content (VOC) of the resulting emulsion to be higher than ideally desired. As such, these organic solvent-based materials are subject to environmental scrutiny.

Hybrids of the above-described prepaste adhesives have been proposed. For example, U.S. Pat. No. 4,719,264 teaches an adhesive composition made from a blend of an aqueous emulsion of a polymer of vinyl acetate, an organic solvent solution of a copolymer of vinyl acetate and vinyl pyrrolidone having dextrin dispersed therein and an aqueous emulsion of an ester gum tackifier. Such materials still face scrutiny because of the VOC issue. Further, the starch present in these materials can cause the above-described heat stability problem. Accordingly, these may not be ideal candidates for prepaste adhesives.

Commonly assigned U.S. Pat. No. 5,387,641 provides an aqueous polymer emulsion suitable for use as a wallpaper prepaste adhesive which includes as the synthetic polymer solids a copolymer or terpolymer derived from hydrolyzed vinyl ester, one or more water soluble monomers and, optionally, an alkyl acrylate and/or methacrylate.

A representative example of an alkaline-swellable oil-in-water emulsion type adhesive is described in U.S. Pat. 4,741,790. To produce a wallcovering having one side coated with the prepaste adhesive, a two pass coating technique is used. In a first pass, an ionic material which is acidic in nature is coated onto a substrate. Thereafter, in a second pass a layer of base, typically $Na_2CO_3$ is coated over the initial coating to neutralize the acid present in the ionic material. This method, while practiced commercially, suffers in that it requires two precise coating passes to yield a satisfactory final product, This can prove to be both cumbersome and costly.

Other references which disclose alkaline-swellable type adhesives include the following: U.S. Pat. Nos. 4,138,381; 4,421,902; 4,384,096; and 4,639,395; and in Shay, "Alkali-Swellable and Alkali-Soluble Thickener Technology", *Polymers in Aqueous Media*, pp. 457–494 (American Chemical Society 1989).

The alkaline swellable polymers typically proposed for use as wallpaper prepaste adhesives are problematic in that they tend to swell too much upon neutralization with a base. As a result, too viscous of a gel is produced for commercial practicability, requiring the above-described two-pass system for commercial operability. Further problems stemming from the two-pass approach include low production output, high energy consumption, uneven consistency of overcoating resulting in localized heterogeneous neutralization.

Despite the above, there still exists a need in the art for an environmentally safe composition which includes an aqueous emulsion which is alkaline soluble and can be used in one coat as a wallcovering prepaste adhesive.

SUMMARY OF THE INVENTION

In accordance with the present invention, novel compositions including aqueous emulsion(s) having a low viscosity and adhesive properties are provided. The compositions primarily function as adhesives, and more specifically, as wallcovering prepaste or brush-on adhesives. Also provided is the process for preparing the novel composition, a wallcovering having at least one side coated with the composition to render it adherable to a surface, and the process for preparing the wallcovering.

One embodiment of the present invention provides a composition comprising a mixture of:

(1) an aqueous emulsion including an acidic polymer which is capable of swelling when in contact with an alkaline material; and (2) an alkaline material;

wherein said composition has a viscosity of less than about 10000 cps at 25° C. and wherein said composition provides adhesive properties.

In particularly preferred embodiments, the acidic polymer is derived from one or more carboxylic acid monomers and one or more nonionic monomers. Further, to yield a superior product, the polymer solids may be crosslinked. In still other preferred embodiments, the acidic polymer has a glass transition temperature ($T_g$) ranging from about −20° C. to about 40° C., the percent of solids in the acidic polymer ranges from about 5% to about 50%, and the viscosity of the acidic polymer emulsion, prior to neutralization ranges from about 5 cps to about 500 cps at 25° C. In still other preferred embodiments the alkaline material comprises a basic material capable of producing a buffering effect with the acidic polymer. In the preferred embodiments, the compositions are extremely heat stable; a property which is required in wallpaper manufacturing (e.g. hot embossing procedures and expandable processing for polyvinylchloride expandable wallpapers.)

Another embodiment of the present invention comprises the process for producing a composition comprising the steps of:

(1) polymerizing one or more monomers in an aqueous environment to yield an aqueous emulsion including an acidic polymer which is capable of swelling when in contact with an alkaline material; and (2) adding an alkaline material to the emulsion of step (1); wherein the composition produced has a viscosity of less than about 10000 cps at 25° C. and wherein said composition provides adhesive properties.

Still another embodiment of the present invention comprises a wallcovering material comprising a substrate having a water remoistenable adhesive on at least one of its surfaces, said adhesive being derived from the above defined composition. In preferred embodiments, the wallcovering material may take the form of strippable wallpaper, vinyl wallpaper, peelable wallpaper, foil wallpaper, cloth fabric and silk, with strippable wallpaper and vinyl wallpaper being particularly preferred.

Another embodiment of the present invention comprises producing a wallcovering comprising a substrate having a water remoistenable adhesive on at least one of its surfaces comprising the steps of applying the above defined composition onto at least one surface of a substrate and then drying the emulsion on the surface.

In preferred embodiments, application of the emulsion to the surface may take place by means of a Myer rod, gravure roller, reverse roller, Flexo-coater, an Air Knife coater or a rotary screen.

Accordingly, it is an object of the present invention to provide novel aqueous compositions having adhesive properties which can be applied onto a substrate in one pass, are environmentally safe, are cost effective, are easy to handle, are non-toxic, demonstrate good paste properties and are compatible with commercially available coating machines.

It is a further object of the present invention to provide a process for producing the novel aqueous compositions.

An additional object of the present invention is to provide a wallcovering material having at least one surface coated with the above composition, drying and which may be easily applied to a surface by wetting the wallcovering material and applying the wallcovering material to the surface.

Still another object of the present invention is to provide a process for producing the wallcovering material.

These and other objects will be readily apparent to those skilled in the art as reference is made to the detailed description of the preferred embodiment.

DETAILED DESCRIPTION OF THE PREFERRED EMBODIMENT

In describing the preferred embodiment, certain terminology will be utilized for the sake of clarity. Such terminology is intended to encompass the recited embodiment, as well as all technical equivalents which operate in a similar manner for a similar purpose to achieve a similar result.

The first component of the inventive composition is an aqueous emulsion including an acidic polymer which is capable of swelling when in contact with an alkaline material. The emulsion includes a polymer derived from one or more acidic monomers and, in preferred embodiments, one or more nonacidic monomers.

The acidic monomer is preferably any ethylenically unsaturated monomer containing carboxylic or sulfonic acid groups and which is capable of providing swellability and adhesion to the emulsion, Particularly preferred monomers include acrylic and methacrylic acid and mixtures thereof. Other acidic monomers which may be selected include itaconic acid, citraconic acid, maleic acid, fumaric acid, crotonic acid, maleic anhydride, citraconic anhydride, 1-allyloxy-2-hydroxypropyl sulfonic acid, crotonic acid and 2-acrylamido-2-methylpropyl sulfonic acid. Mixtures of all the monomers described above may also be selected.

Although the emulsion may be comprised of a polymer solely derived from acidic monomers in preferred embodiments the polymer is derived from a combination of acidic and nonacidic monomers (i.e., monomers that do not contain carboxylic or sulfonic acid groups). Examples of nonacidic monomers which may be used in combination with the acidic monomers include any ethylenically unsaturated monomers which can be readily copolymerized with the acidic monomers. Specific examples include alkyl acrylates or alkyl methacrylates, wherein alkyl represents an alkyl group containing between 1 and 20 carbon atoms is provided. Examples of alkyl acrylates and methacrylates include ethyl acrylate, butyl acrylate, methyl methacrylate, methyl acrylate, ethylhexylacrylate, hydroxyethylacrylate, hydroxyethylmethacrylate, hydroxypropylacrylate, hydroxypropyl-methacrylate, stearyl methacrylate and lauryl methacrylate. Other nonacidic monomers include styrene, vinyl acetate, ethylene, butadiene, acrylamide, acrylonitrile, alkyl- or dihalo-substituted styrene, vinyl or vinylidene chloride or other halide. Mixtures of any of the above nonacidic monomers may be selected.

When forming a copolymer including both acidic and nonacidic monomers, the amount derived from the acidic monomer typically ranges from about 20 to about 50 percent by weight of polymer solids, with weight percents ranging from about 30 to about 40 percent by weight of polymer solids being even more preferred.

In still other embodiments, there may also be added a minor amount of monomer which can both copolymers in combination with the other monomers and provide an amount of surface active properties to the polymer. Examples of such surface active monomers include behenyl methacrylate, lauryl methacrylate, tristyryl phenol polyethylene oxy-methacrylate and stearyl methacrylate. When selected, the amount of polymer solids derived from such surface active polymers typically ranges from about 0.01 to about 5.0 percent, with amounts ranging from about 1.0 to about 3.0 percent by weight of the polymer solids being even more preferred.

The polymer formed in the aqueous emulsion is preferably crosslinked. This is accomplished by adding between about 0.01 and about 5.0 weight percent of one or more crosslinking agents to the emulsion. Examples of suitable crosslinking agents include ethylene glycol dimethacrylate, pentaerythritol tetracrylate, dipentaerythritol pentacrylate, trimethylolpropane trimethacrylate, pentaerythritol triacrylate, polyethylene glycol diacrylate, divinylbenzene and triallyl isocyanurate, with ethylene glycol dimethacrylate and trimethylolpropane trimethacrylate being particularly preferred. Mixtures of the above crosslinking agents may be used.

Typically also present in the emulsion is one or more surfactants and/or protective colloids. These materials are present in amounts ranging from about 0.5 to 5 weight percent of the emulsion, with amounts ranging between about 1 to 5 weight percent being more preferred. Examples of suitable surfactants include ammonium lauryl ether sulfate, sodium lauryl ether sulfate, sodium dodecylbenzene sulfonate, octyl phenol ethoxylates (30–50 moles of ethylene oxide), nonyl phenol ethoxylates (30–50 moles of ethylene oxide), sodium lauryl sulfate, and phosphate esters such as ammonium or sodium salts of poly(oxy-1,2-ethanediyl), α-(nonylphenol)-ω-hydroxy-phosphate,poly (oxy-1,2-ethanediyl),α-phenol-ω-hydroxy-phosphate and poly(oxy-1,2-ethanediyl),α-(octylphenol)-ω-hydroxy-phosphate. These materials are commercially sold by Rhone-Poulenc Inc. under the trade names Abex JKB, Abex VA-50, Abex 2050, Abex 23S, Alkasurf NP-40, Rhodasurf RP-710, Sipon LSB, Alkasurf NP-50, Rhodocal DS-4, Rhodafac R9-25A, Rhodasurf RE-610 and Rhodasurf RE-960.

Examples of protective colloids which may be selected include poly[vinyl alcohol], hydroxyethyl cellulose, poly [vinyl pyrrolidone], sodium polyacrylate and condensation products of polyethylene glycol with fatty acid, long chain alkylene or polyhydroxy fatty acids. Examples of the condensation products are sold by ICI under the Hypermer name.

Further, the final emulsion may include between about 0.01 and 10.0 by weight percent of the emulsion of other additives to improve paste properties such as antifoaming agents, fungicides, biocides, clays, paste body enhancers to increase slip and the like. These materials are well known in the art.

To produce the emulsion the surfactant and/or protective colloid, if any, is added to water and the solution is heated to between about 50° and about 150° C., more preferably to about 80°–100° C. In a separate vessel, the monomers, cross-linking agents, and other additives are combined under agitation to form a pre-emulsion. Before adding the monomer pre-emulsion to the initial water vessel an amount of a polymerization initiator is added to the water vessel.

The polymerization initiator may take the form of many known initiators such as azo, peroxide, persulfate, perester and redox initiators. The amount of initiator added to the solution typically ranges from between about 0.05 to about 2 weight percent of the emulsion with amounts ranging from about 0.1 to about 0.5 weight percent being particularly preferred. Particularly preferred is the use of persulfate initiators such as sodium persulfate, potassium persulfate, ammonium persulfate and the like, with sodium persulfate being particularly preferred. Other free radical initiators which may be selected include peroxide materials such as benzoyl peroxide, cumene hydroperoxide, hydrogen peroxide, acetyl peroxide, lauroyl peroxide, peresters such as t-butylperoxypivalate, a-cumylperoxypivalate and t-butylperoctoate, and azo (azobisnitrile) type initiators (water or oil soluble) such as 2,2'-azobis-(2-methylpropanenitrile), 2,2'-azobis-(2,4-dimethylpentanenitdle), 2,2'-azobis-(2-methylbutanenitrile), 1,1'-azobis-(cyclohexanecarbonitrile), 2,2'-azobis-(2,4-dimethyl-4-methoxyvaleronitrile) and 2,2'-azobis-(2-amidinopropane) hydrochloride. The initiators may be added in an inert solvent such as water or acetone.

Once the initiator is added into the water/surfactant solution, the monomer pre-emulsion is metered into the reactor at between about 50° and about 150° C., and more preferably at about 80°–100° C. In practice, the pre-emulsion addition can take from 30 minutes to six hours, with addition times between 90 minutes and 4 hours being preferred. Thereafter, the emulsion is maintained at the approximate temperature of the initial water/surfactant mixture for a period of time, for example 2 hours, until the monomers have fully polymerized. Using the above method can convert over 99.5% of the monomers to polymeric form.

The polymer produced in the emulsion typically comprises between about 5 to about 50 percent by weight of the emulsion with amounts between about 20 and 50 percent by weight being more preferred and amounts between about 25 and 35 percent by weight of the emulsion being even more preferred. The average particle size of the polymer produced in the emulsion is typically between about 100 and about 500 nanometers. The viscosity of the emulsion produced as measure by a Brookfield Viscometer (LV, #2, 60 rpm) ranges from about 5 to about 500 cps.

In addition, by carefully selecting the monomers used to form the polymer in the emulsion, polymers having particularly preferred glass transition temperatures ($T_g$) can be produced. The glass transition temperature produced can be particularly important as it can be an indicator of the polymer's ability to swell when contacted with alkaline materials. As a general rule, an increasing polymer $T_g$ is inversely proportional to the emulsion's ability to swell when contacted with alkaline materials (i.e., a lower Tg yields an emulsion which more easily swells when contacted with alkaline). In accordance with the present invention, the $T_g$ of the polymer produced ranges from about −20° to about 40° C., even more preferably from about −5° to about 25° C. Blends of polymers may also be utilized in the present invention. Such blends may take the form of physical blends of separate emulsions containing different polymers, core shell polymer morphology, and the like.

A further factor to consider when selecting the monomers used to form the polymer is the hydrophilicity of the polymer. As stated above, as a general rule it is more difficult to swell a polymer having a relatively high $T_g$. However, even if a high $T_g$ polymer is selected, if it has high levels of hydrophilicity, it may be capable of swelling.

The second component used to form the inventive composition is an alkaline material which reacts with the polymer of the emulsion to provide adhesive properties and increase the viscosity of the resulting mixture. Any alkaline material may be selected so long as the resulting viscosity of the mixture is low enough so that it can be easily coated onto a substrate using commercially available coating machines. Examples of alkaline materials which may be used to partially or completely neutralize the emulsion include sodium hydroxide, sodium carbonate, potassium hydroxide, ammonium hydroxide and potassium carbonate, alkali metal or alkaline earth mono, di or tribasic phosphates, borate's, acetates, other acid salts of weak bases and mixtures thereof.

The use of alkaline materials which can produce a buffering effect on the acidic polymer upon neutralization comprises a preferred embodiment of the present invention. The term "buffering effect" is intended to define the ability of one or more acidic hydrogenous from the acidic polymer of the emulsion to undergo continuous ionic exchange with the cationic portion of the alkaline material. Specific examples of suitable alkaline materials include alkali metal and alkaline earth metal mono-, di- and triphosphates and mixtures thereof. For example, it is hypothesized that if trisodium phosphate is added to an emulsion including an acidic polymer, the sodium atoms from the trisodium phosphate will undergo ionic exchange with the hydrogen atom of the acidic polymer, resulting in a composition whose viscosity does not appreciably increase over time while retaining excellent adhesive properties. It is hypothesized that the use of such alkaline materials capable of providing a buffering effect is a marked improvement over prior art systems as it enables the production of a unitary (i.e., can be applied in one coating) adhesive which is stable for long periods of time. For example, the resulting adhesive composition may retain a viscosity of less than 10000 cps for greater than seven days, and even more preferably greater than thirty days.

The inventors also believe that unless the buffering effect is achieved, the resulting material must be immediately used before its viscosity becomes too high for practical application. For example, the neutralization of an acidic polymer with sodium hydroxide may yield a useful unitary adhesive material which maintains a viscosity of less than 10000 cps for a few hours but, after that time period will then rise to where it cannot be practically used.

The amount of alkaline material which is added to the polymer emulsion, typically under shear mixing conditions, is that amount which provides the desired degree of neutralization and which will cause the polymer emulsion to develop adhesive properties and swell and having a viscosity of less than 10000 cps as measure by a Brookfield Viscometer (LV, #2, 60 rpm). Even more preferred is a final composition having a viscosity between about 100 and about 5000 cps. The percent of solids in the final composition typically ranges from about 5 to about 30 percent by weight, with an amount ranging from about 10 to about 20 percent being particularly preferred.

The resulting composition maintains its low viscosity and adhesiveness despite being subject to shear forces during mixing and subsequent coating operations. In fact, the viscosity of the composition may actually decrease under shear conditions, yielding an even more flowable composition which is later used.

Once the composition is prepared it may either be used "as is" as a brush on wallcovering adhesive but is more preferably used as a wallcovering prepaste adhesive.

To produce a wallcovering material having a prepaste adhesive on one of its surfaces, the above low viscosity composition is coated onto one surface of the substrate and the surface is dried. The substrate typically comprises strippable wallpaper, vinyl wallpaper, peelable wallpaper, foil wallpaper, cloth fabric or silk, with strippable wallpaper and vinyl wallpaper being particularly preferred substrate materials.

The composition can be prepared and immediately coated onto the substrate, as is the case with the use of alkaline materials which do not demonstrate a buffering effect or may be coated after a period of storage, as is the case with the use of alkaline materials which demonstrate a buffering effect.

Application of the composition to the substrate surface can be accomplished by any of the commonly known methods. These include Myer rod, gravure roller, reverse roller, rotary screen, Flexo-coater and Air Knife coater. In practice the coating weight of the composition applied to the surface ranges from about 2 to about 20 grams/meter$^2$(g/m$^2$), preferably ranges from about 4 to about 10 grams/meter$^2$, with a coating weight of from about 5 to about 8 grams/meter$^2$ being particularly preferred. Achieving the desired coating weight can be accomplished in one pass. This is specifically contrasted form prior alkali swellable paste systems which require multiple coatings to yield a suitable product.

After the emulsion has been coated onto the substrate, it is dried, typically by using a commercial paper dryer. Such ovens typically operate at an air temperature between about 70° C. and about 200° C. Thereafter, the substrate, particularly if it is wallpaper may be sent to a printing station where decorative printing is applied to the non-coated surface (alternatively, the paper may be printed prior to coating the prepaste onto the non-printed surface). The wallcovering is then packaged and shipped for customer use.

To use the wallcovering having the adhesive composition coated and dried on one surface thereon, the surface containing the adhesive, or more commonly, the entire wallcovering is immersed in water. The water causes the solids in the emulsion coating to swell, yielding a thin adhesive film. The adhesive surface is then applied to the wall or other surface to be treated.

The compositions of the present invention possess no volatile organic content (VOC), and as such are environmentally friendly materials.

The invention is described in greater detail by the following non-limiting examples.

EXAMPLE 1

In a first vessel 0.30 parts of sodium dodecylbenzene sulfonate are added to 594.29 parts of demineralized water and the mixture is heated to 85° C. In a separate vessel, a pre-emulsion is formed by adding 59.04 parts ethyl acrylate, 149.43 parts butyl acrylate, 89.97 parts methacrylic acid, 1.45 parts ethylene glycol dimethacrylate and 1.01 parts sodium dodecylbenzene sulfonate to 98.47 parts of demineralized water. The vessel is agitated and heated. When the vessel's contents reach a temperature of 85° C. a solution of 1.77 parts sodium persulfate in 4.27 parts demineralized water is added to the vessel. The pre-emulsion is then added over a two hour time period to the first vessel and the temperature is maintained at 85° C. After addition, the vessel is maintained at 85° C. for two hours and is then cooled to 25° C. The percent solids of the resulting polymer emulsion is about 30%, and the viscosity of the material is less than 100 cps, as measured by a Brookfield Viscometer (LV, #2, 60 rpm, 25° C.).

EXAMPLE 2

To a first vessel 0.30 parts of sodium dodecylbenzene sulfonate are added to 594.29 parts of demineralized water and the mixture is heated to 85° C. In a separate vessel, a pre-emulsion is formed by adding 91.53 parts ethyl acrylate, 87.26 parts butyl acrylate, 119.65 parts methacrylic acid, 1.45 ethylene glycol dimethacrylate and 1.01 parts sodium dodecylbenzene sulfonate to 98.47 parts of demineralized water. The vessel is agitated and heated. When the vessel's contents reach a temperature of 85° C. a solution of 1.77 parts sodium persulfate in 4.27 parts demineralized water is added to the vessel. The pre-emulsion is then added over a two hour time period to the first vessel and the temperature is maintained at 85° C. for two hours and is then cooled to 25° C. The percent solids of the resulting polymer emulsion is about 30%, and the viscosity of the material is less than 100 cps, as measured by a Brookfield Viscometer (LV, #2, 60 rpm, 25° C.).

EXAMPLES 3–15

Several emulsion polymer samples are prepared by a similar method as example 1 and 2 with different monomer compositions. These samples are listed in Table #1. All of the resulting polymer emulsions are about 30% solids and have viscosities less than 100 cps, as measured by a Brookfield Viscometer (LV, #2, 60 rpm, 25° C.). The compositions are listed in parts by weight.

EXAMPLE 16

209.03 parts of Example I are neutralized by adding the emulsion to a solution of 14.34 parts trisodium phosphate and 28.95 parts disodium hydrogen phosphate in 747.68 parts water. The viscosity of the resulting material is 2,500 cps when initially prepared. This material has a viscosity of 3,500 cps after 1 day, a percent solids of 10.6% and a pH of 6.7. The viscosities are measured with a Brookfield viscometer (LV, #4, 60 rpm, 25° C.).

This material is dried on vinyl wallpaper at a coat weight of 8 g/m$^2$ and on strippable wallpaper at a coat weight of 5g/m$^2$. In both cases, the resulting paste feel is excellent.

EXAMPLES 17–48

The latexes of these examples are neutralized in a similar method as the method of Example 16. These neutralized solutions are coated on vinyl wallpapers at a coat weight of about 8 g/m$^2$ and on strippable wallpaper at a coat weight of about 5 g/m$^2$. The neutralized latexes are summarized in Table #2, and the paste performance results are summarized in Table #3.

EXAMPLES 48–61

59.15 parts of the Example 1 composition are blended with 263.57 parts of the Example 2 composition. The resulting latex is neutralized with a solution of 17.60 parts trisodium phosphate and 35.58 parts of disodium hydrogen phosphate dissolved in 624.10 parts water. The viscosity of this material is 400 cps when initially prepared. This viscosity of the material at 15% solids becomes stabilized at about 900 cps after 1 day. The viscosities are measured with a Brookfield viscometer (LV, #4, 60 rpm, 25° C.).

This material is drawn-down to vinyl paper (8 g/m$^2$) and strippable paper (5 g/m$^2$). In both cases, good paste properties are obtained. (Example 51)

The results of several blends of latexes are summarized in Tables #-4 and #5 (Examples 48–50, 52–61).

EXAMPLE 62

To a first vessel 0.30 parts of sodium dodecylbenzene sulfonate are added to 594.29 parts of demineralized water and the mixture is heated to 85° C. In a separate vessel, a pre-emulsion is formed by adding 18.33 parts ethyl acrylate (EA), 17.44 parts butyl acrylate (BA), 23.95 parts methacrylic acid (MAA), 0.29 parts ethylene glycol dimethacrylate (EDGM) and 0.20 parts sodium dodecylbenzene sulfonate (SDBS) to 19.68 parts of demineralized water. The vessel is agitated and heated. When the vessel's contents reach a temperature of 85° C. a solution of 1.77 parts sodium persulfate in 4.27 parts demineralized water is added. The pre-emulsion is then added over 25 minutes to the vessel at a temperature of 85° C. and after addition, the vessel is maintained at 85° C. for one half hour. A second pre-emulsion is prepared in a separate vessel by adding 47.23 parts ethyl acrylate, 119.53 parts butyl acrylate, 71.96 parts methacrylic acid, 1.16 parts ethylene glycol dimethacrylate and 0.81 parts sodium dodecylbenzene sulfonate to 78.79 parts of demineralized water. After maintaining the vessel at 85° C. for one half hour the second pre-emulsion is added to the vessel over 95 minutes while maintaining the vessel at 85° C. After addition, the vessel is maintained at 85° C. for two hours, and is then cooled to 25° C. The percent solids of the resulting polymer emulsion is about 30% and the viscosity of the material is less than 100 cps, as measured by a Brookfield Viscometer (LV, #2, 60 rpm, 25° C.).

EXAMPLES 63–65

Several emulsion polymers are prepared using a similar method to that used in EXAMPLE 62. Only the composition of the two pre-emulsions used are varied. These samples are summarized in Table #6.

EXAMPLES 66–73

322.16 parts of EXAMPLE 62 are neutralized by adding the emulsion to a solution of 17.65 parts trisodium phosphate and 35.70 disodium hydrogen phosphate in 624.49 parts of demineralized water. The resulting material (EXAMPLE 66) has a viscosity of 250 cps when initially prepared and has a stable viscosity of 5,600 cps after 1 day, and a percent solids of 15%. The viscosities are measured using a Brookfield Viscometer (LV, #4, 60 rpm, 25° C.). This material is laid down to vinyl wallpaper at a coating weight of 8 g/m$^2$ and to strippable wallpaper at a coating weight of 5 g/m$^2$. In both cases, the resulting paste feel is very good upon rewetting.

Examples 62–65 are neutralized in a similar manner as above. The results are summarized in Table #7. Each sample is coated on both vinyl wallpaper and strippable wallpaper using the above conditions. The results are summarized in Table #8.

EXAMPLE 74

The effect of crosslinking levels is examined by carrying out the emulsion polymerization in a same manner as in EXAMPLE 62. The resulting latexes are then neutralized to achieve a 15% solids solution and a draw-down performance test is performed to vinyl wallpaper at a coating weight of about 8 g/m$^2$. The results are shown in Table #9.

FIELD TESTING OF INVENTIVE MATERIALS

To determine if the composition of the present invention effectively functions as wallpaper prepaste adhesives, experiments are conducted using the following composition on both strippable wallpaper and vinyl wallpaper.

To produce the test composition 216.92 parts of the Example 2 polymer emulsion are added to 738.16 parts water. The emulsion is neutralized by the addition of 14.88 parts of trisodium phosphate and 30.04 parts of disodium hydrogen phosphate. The viscosity of the resulting material is about 4000 cps, the percent solids is 10.6 and the pH is 6.7.

(1) Strippable paper: The test composition is applied to strippable wallpaper stock with a Dahlgren reverse roll type coater under the following conditions:

Oven Temperature: 160° C.—Zone 1; 155° C.—Zone 2

Pick-Up Roller Setting: 2.5

Transfer Roller Speed: 400 rpm

Paper Speed 140 meters/minute

When coating the material, it is subjected to shear forces such that the viscosity of the composition when coating is actually about 1500 cps at the point of coating. Despite the change in viscosity, the material retains its adhesive nature.

The coating weight at various points on the paper stock is as follows:

Left Edge of Paper: 4.5 g/m$^2$

Left Center portion of Paper: 4.3 g/m$^2$

Right Center portion of Paper: 5.3 g/m$^2$

Right Edge of Paper: 4.1 g/m$^2$

The paste feel is good having very good slip and the consistency of the coating is considered excellent. The prepasted wallpaper is immersed in water for 10 seconds and applied to a wall.

The paper hangs on the wall very well, giving excellent wet and dry adhesion. In addition, upon application the paper does not curl.

(1) Vinyl paper: The test composition is applied to vinyl wallpaper stock with a Dahlgren reverse roll type coater under the following conditions:

Oven Temperature 165° C.—Zone 1: 160° C.—Zone 2

Pick-Up Roller Setting 2.05

Transfer Roller Speed 400 rpm

Paper Speed 100 meters/minute

When coating the material, it is subjected to shear forces such that the viscosity of the composition when coating is actually about 1500 cps at the point of coating. Despite the change in viscosity, the material retains its adhesive nature.

The coating weight at various points on the paper stock is as follows:

Left Edge of Paper: 5.5 g/m$^2$

Right Edge of Paper: 5.5 g/m$^2$

The paste feel and body qualitatively feels lighter than that applied to the strippable paper, although it possesses very good slip and the consistency of the coating is considered excellent. It is considered that increasing the coating weight to 7 to 8 g/m$^2$ would yield an even better paste feel. The prepasted wallpaper is immersed in water for 10 seconds and applied to a wall. The paper hangs on the wall very well, giving excellent wet and dry adhesion. In addition, upon application the paper does not curl.

TABLE 1

| SAMPLE | ETHYL ACRYLATE | BUTYL ACRYLATE | METHYL METH-ACRYLATE | ETHYLENE GLYCOL DIMETH-ACRYLATE |
|---|---|---|---|---|
| Example 3 | 73.83 | 104.96 | 119.65 | 1.45 |
| Example 4 | 59.04 | 119.75 | 119.65 | 1.45 |
| Example 5 | 44.25 | 134.54 | 119.65 | 1.45 |
| Example 6 | 91.53 | 101.94 | 104.97 | 1.45 |
| Example 7 | 59.04 | 134.43 | 104.97 | 1.45 |
| Example 8 | 44.25 | 149.22 | 104.97 | 1.45 |
| Example 9 | 77.74 | 121.67 | 99.03 | 1.45 |
| Example 0 | 66.28 | 133.13 | 99.03 | 1.45 |
| Example 11 | 91.53 | 116.94 | 89.97 | 1.45 |
| Example 12 | 85.91 | 122.56 | 89.97 | 1.45 |
| Example 13 | 75.91 | 132.56 | 89.97 | 1.45 |
| Example 14 | 70.29 | 138.19 | 89.97 | 1.45 |
| Example 15 | 42.17 | 166.30 | 89.97 | 1.45 |

TABLE 2

| SAMPLE | NEUTRALIZED POLYMER | PARTS LATEX | PARTS $Na_3PO_4$ | PARTS $Na_2HPO_4$ | PARTS $H_2O$ | % SOLID | INITIAL VISCOSITY | STABILIZED VISCOSITY |
|---|---|---|---|---|---|---|---|---|
| Example 16 | Example 1 | 209.03 | 14.03 | 28.95 | 747.68 | 10.6% | 2,500 cps | 3,500 cps |
| Example 17 | Example 3 | 295.77 | 20.29 | 40.96 | 642.98 | 15% | 7,300 cps | — |
| Example 18 | Example 4 | 295.77 | 20.29 | 40.96 | 642.98 | 15% | 9,400 cps | — |
| Example 19 | Example 5 | 295.77 | 20.29 | 40.96 | 642.98 | 15% | 2,000 cps | — |
| Example 20 | Example 1 | 218.24 | 9.97 | 34.55 | 737.24 | 11% | 1,200 cps | 4,000 cps |
| Example 21 | Example 1 | 219.56 | 5.03 | 39.10 | 736.31 | 11% | 800 cps | 3,800 cps |
| Example 22 | Example 1 | 220.93 | 0 | 43.72 | 735.35 | 11% | 150 cps | 2,200 cps |
| Example 23 | Example 6 | 311.72 | 18.70 | 37.78 | 631.80 | 15% | 8,900 cps | — |
| Example 24 | Example 7 | 311.72 | 18.70 | 37.78 | 631.80 | 15% | 1,300 cps | 16,000 cps |
| Example 25 | Example 8 | 311.72 | 18.70 | 37.78 | 631.80 | 15% | 50 cps | 1,200 cps |
| Example 26 | Example 9 | 318.54 | 18.03 | 36.41 | 627.02 | 15% | 100 cps | 9,300 cps |
| Example 27 | Example 10 | 318.54 | 18.03 | 36.41 | 627.02 | 15% | 150 cps | 1,400 cps |
| Example 28 | Example 9 | 274.66 | 20.71 | 26.89 | 677.74 | 13% | 500 cps | 2,400 cps |
| Example 29 | Example 10 | 274.66 | 20.71 | 26.89 | 677.74 | 13% | 100 cps | 500 cps |
| Example 30 | Example 9 | 273.16 | 25.76 | 22.29 | 678.79 | 13% | 1,700 cps | 3,100 cps |
| Example 31 | Example 10 | 273.16 | 25.76 | 22.29 | 678.79 | 13% | 550 cps | 1,250 cps |
| Example 32 | Example 11 | 329.46 | 16.93 | 34.23 | 619.38 | 15% | 700 cps | 25,000 cps |
| Example 33 | Example 12 | 329.46 | 16.93 | 34.23 | 619.38 | 15% | 20 cps | 100 cps |
| Example 34 | Example 13 | 329.46 | 16.93 | 34.23 | 619.38 | 15% | 60 cps | 600 cps |
| Example 35 | Example 14 | 329.46 | 16.93 | 34.23 | 619.38 | 15% | 50 cps | 800 cps |
| Example 36 | Example 2 | 329.46 | 16.93 | 34.23 | 619.38 | 15% | 20 cps | 150 cps |
| Example 37 | Example 15 | 329.46 | 16.93 | 34.23 | 619.38 | 15% | 100 cps | 500 cps |
| Example 38 | Example 12 | 327.79 | 22.49 | 29.17 | 620.55 | 15% | 200 cps | 1,800 cps |
| Example 39 | Example 13 | 327.79 | 22.49 | 29.17 | 620.55 | 15% | 150 cps | 2,700 cps |
| Example 40 | Example 14 | 327.79 | 22.49 | 29.17 | 620.55 | 15% | 400 cps | 11,000 cps |
| Example 41 | Example 2 | 327.79 | 22.49 | 29.17 | 620.55 | 15% | 30 cps | 400 cps |

TABLE 2-continued

| SAMPLE | NEUTRALIZED POLYMER | PARTS LATEX | PARTS $Na_3PO_4$ | PARTS $Na_2HPO_4$ | PARTS $H_2O$ | % SOLID | INITIAL VISCOSITY | STABILIZED VISCOSITY |
|---|---|---|---|---|---|---|---|---|
| Example 42 | Example 12 | 326.16 | 27.95 | 24.20 | 621.69 | 15% | 1,400 cps | 4,000 cps |
| Example 43 | Example 13 | 326.16 | 27.95 | 24.20 | 621.69 | 15% | 800 cps | 6,200 cps |
| Example 44 | Example 14 | 326.16 | 27.95 | 24.20 | 621.69 | 15% | 1,700 cps | 12,600 cps |
| Example 45 | Example 2 | 326.16 | 27.95 | 24.20 | 621.69 | 13% | 100 cps | 1,400 cps |
| Example 46 | Example 13 | 281.26 | 28.91 | 16.71 | 673.12 | 13% | 300 cps | 900 cps |
| Example 47 | Example 14 | 281.26 | 28.91 | 16.71 | 673.12 | 13% | 600 cps | 1,900 cps |
| Example 48 | Example 2 | 281.26 | 28.91 | 16.71 | 673.12 | 13% | 100 cps | 200 cps |

TABLE 3

| | PASTE FEEL | |
|---|---|---|
| SAMPLE | VINYL PAPER (8 G/M$^2$) | STRIPPABLE (5 G/M$^2$) |
| Example 16 | excellent | excellent |
| Example 17 | good | good |
| Example 18 | good | good |
| Example 19 | fair | fair |
| Example 20 | very good | very good |
| Example 21 | good | good |
| Example 22 | good | good |
| Example 23 | good | good |
| Example 24 | good | good |
| Example 25 | fair | fair |
| Example 26 | very good | very good |
| Example 27 | good | good |
| Example 28 | good | good |
| Example 29 | good | good |
| Example 30 | very good | very good |
| Example 31 | very good | very good |
| Example 32 | good | good |
| Example 33 | good | good |
| Example 34 | good | good |
| Example 35 | good | good |
| Example 36 | good | good |
| Example 37 | fair | fair |
| Example 38 | good | good |
| Example 39 | good | good |
| Example 40 | good | good |
| Example 41 | good | good |
| Example 42 | good | good |
| Example 43 | good | good |
| Example 44 | good | good |
| Example 45 | good | good |
| Example 46 | very good | very good |
| Example 47 | very good | very good |
| Example 48 | very good | very good |

TABLE 5

| | PASTE FEEL | |
|---|---|---|
| SAMPLE | VINYL PAPER (8 G/M$^2$) | STRIPPABLE (% G/M$^2$) |
| Example 48 | very good | very good |
| Example 49 | very good | very good |
| Example 50 | very good | very good |
| Example 51 | very good | very good |
| Example 52 | very good | very good |
| Example 53 | very good | very good |
| Example 54 | very good | very good |
| Example 55 | very good | very good |
| Example 56 | very good | very good |
| Example 57 | very good | very good |
| Example 58 | very good | very good |
| Example 59 | very good | very good |
| Example 60 | good | good |
| Example 61 | good | good |

TABLE 4

| SAMPLE | LATEX 1 | LATEX 2 | PARTS LATEX 1 | PARTS LATEX 2 | PARTS $Na_3PO_4$ | PARTS $Na_2HPO_4$ | PARTS $H_2O$ | % SOLID | INITIAL VISCOSITY | STABLE VISCOSITY |
|---|---|---|---|---|---|---|---|---|---|---|
| Example 48 | Example 1 | Example 12 | 59.15 | 263.57 | 17.60 | 35.58 | 624.10 | 15% | 1,200 cps | 3,800 cps |
| Example 49 | Example 1 | Example 13 | 59.15 | 263.57 | 17.60 | 35.58 | 624.10 | 15% | 900 cps | 4,200 cps |
| Example 50 | Example 1 | Example 14 | 59.15 | 263.57 | 17.60 | 35.58 | 624.10 | 15% | 1,100 cps | 7,300 cps |
| Example 51 | Example 1 | Example 2 | 59.15 | 263.57 | 17.60 | 35.58 | 624.10 | 15% | 400 cps | 900 cps |
| Example 52 | Example 1 | Example 12 | 88.73 | 230.62 | 17.94 | 36.25 | 626.46 | 15% | 2,200 cps | 5,100 cps |
| Example 53 | Example 1 | Example 13 | 88.73 | 230.62 | 17.94 | 36.25 | 626.46 | 15% | 1,700 cps | 5,200 cps |
| Example 54 | Example 1 | Example 14 | 88.73 | 230.62 | 17.94 | 36.25 | 626.46 | 15% | 2,400 cps | 6,800 cps |
| Example 55 | Example 1 | Example 2 | 88.73 | 230.62 | 17.94 | 36.25 | 626.46 | 15% | 900 cps | 4,000 cps |
| Example 56 | Example 1 | Example 12 | 118.31 | 197.68 | 18.27 | 18.27 | 628.82 | 15% | 2,700 6,100 | cps |
| Example 57 | Example 1 | Example 13 | 118.31 | 197.68 | 18.27 | 18.27 | 628.82 | 15% | 2,700 cps | 5,800 cps |
| Example 58 | Example 1 | Example 14 | 118.31 | 197.68 | 18.27 | 18.27 | 628.82 | 15% | 3,400 cps | 8,900 cps |
| Example 59 | Example 1 | Example 2 | 118.31 | 197.68 | 18.27 | 18.27 | 628.82 | 15% | not tested | not tested |
| Example 60 | Example 1 | Example 13 | 58.81 | 262.23 | 23.37 | 23.37 | 625.27 | 15% | 1,800 cps | 6,500 cps |
| Example 61 | Example 1 | Example 13 | 119.05 | 198.67 | 12.26 | 12.26 | 627.60 | 15% | 800 cps | 4,150 cps |

TABLE 6

| SAMPLE | PARTS EA | PARTS BA | PARTS MAA | PARTS EGDMA | PARTS SDBS | PARTS $H_2O$ | ADDITION TIME (MIN) |
|---|---|---|---|---|---|---|---|
| | | | 1st Pre-emulsion | | | | |
| Example 63 | 18.33 | 17.44 | 23.95 | 0.29 | 0.20 | 19.68 | 25 |
| Example 64 | 13.75 | 13.08 | 17.97 | 0.21 | 0.16 | 14.79 | 18 |
| Example 65 | 13.75 | 13.08 | 17.97 | 0.21 | 0.16 | 14.79 | 18 |
| | | | 2nd Pre-emulsion | | | | |
| Example 63 | 60.71 | 106.05 | 71.96 | 1.16 | 0.81 | 78.79 | 95 |
| Example 64 | 64.50 | 112.66 | 76.48 | 1.24 | 0.85 | 83.68 | 102 |
| Example 65 | 50.19 | 126.97 | 76.49 | 1.24 | 0.85 | 83.68 | 102 |

TABLE 7

| SAMPLE | NEUTRALIZED POLYMER | PARTS LATEX | PARTS $Na_3PO_4$ | PARTS $Na_2HPO_4$ | PARTS $H_2O$ | % SOLID | INITIAL VISCOSITY | STABILIZED VISCOSITY |
|---|---|---|---|---|---|---|---|---|
| Example 66 | Example 62 | 322.16 | 17.65 | 35.70 | 624.49 | 15% | 250 cps | 5,600 cps |
| Example 67 | Example 63 | 322.16 | 17.65 | 35.70 | 624.49 | 15% | 500 cps | 14,200 cps |
| Example 68 | Example 62 | 323.83 | 11.85 | 41.00 | 623.32 | 15% | 200 cps | 1,600 cps |
| Example 69 | Example 63 | 323.83 | 11.85 | 41.00 | 623.32 | 15% | 400 cps | 3,600 cps |
| Example 70 | Example 64 | 323.91 | 17.49 | 35.34 | 623.26 | 15% | 400 cps | 3,500 cps |
| Example 71 | Example 65 | 323.91 | 17.49 | 35.34 | 623.26 | 15% | 150 cps | 2,500 cps |
| Example 72 | Example 64 | 322.24 | 23.20 | 30.13 | 624.43 | 15% | 1,900 cps | 8,100 cps |
| Example 73 | Example 65 | 322.24 | 23.20 | 30.13 | 624.43 | 15% | 800 cps | 6,800 cps |

TABLE 8

| | PASTE FEEL | |
|---|---|---|
| SAMPLE | VINYL PAPER (8 G/M$^2$) | STRIPPABLE PAPER (5 G/M$^2$) |
| Example 66 | very good | very good |
| Example 67 | very good | very good |
| Example 68 | good | good |
| Example 69 | good | good |
| Example 70 | good | good |

TABLE 8-continued

| | PASTE FEEL | |
|---|---|---|
| SAMPLE | VINYL PAPER (8 G/M$^2$) | STRIPPABLE PAPER (5 G/M$^2$) |
| Example 71 | good | good |
| Example 72 | very good | very good |
| Example 73 | very good | very good |

TABLE 9

RESULTS OF TWO STAGE POLYMERIZATION SAMPLES WITH VARIOUS AMOUNTS OF CROSSLINKING AGENT

CORE: EA:BA:MAA (31:23:46)(BY MOLE)

SHELL: EA:BA:MAA (21:42:37)(BY MOLE)

Neutralized with a 30% $Na_3PO_4$ + 70% $Na_2H\ PO_4$ (by weight) mixture solution. The final solution is 15% solids.

| SAMPLE EXAMPLE 74 | RATIO CORE/SHELL | % CROSSLINKING IN CORE | % CROSSLINKING IN SHELL | VISCOSITY (INITIAL) | VISCOSITY (AFTER 1 DAY) | PASTE FEEL |
|---|---|---|---|---|---|---|
| A | 2:8 | 0.5% | 0.5% | 250 cps | 5,600 cps | good |
| B | 2:8 | 0.5% | 1.0% | 500 cps | 6,200 cps | good |
| C | 2:8 | 1.0% | 1.0% | 200 cps | 2,300 cps | good |
| D | 2:8 | 1.5% | 1.5% | 100 cps | 600 cps | fair |
| E | 2:8 | 2.0% | 0.5% | 200 cps | 2,900 cps | good |
| F | 2:8 | 2.0% | 1.0% | 150 cps | 800 cps | good |
| G | 2:8 | 3.0% | 0.5% | 200 cps | 2,600 cps | good |
| H | 3:7 | 2.0% | 1.0% | 400 cps | 2,400 cps | very good |
| I | 3:7 | 3.0% | 0.5% | 500 cps | 3,500 cps | very good |
| J | 3:7 | 3.0% | 1.0% | 250 cps | 1,100 cps | very good |
| K | 3:7 | 3.0% | 1.5% | 200 cps | 1,000 cps | good |
| L | 3:7 | 5.0% | 0.5% | 200 cps | 1,100 cps | very good |
| M | 3:7 | 5.0% | 1.0% | 150 cps | 500 cps | very good |
| N | 4:6 | 3.0% | 1.0% | 500 cps | 3,800 cps | very good |

TABLE 9-continued

RESULTS OF TWO STAGE POLYMERIZATION SAMPLES WITH VARIOUS AMOUNTS OF CROSSLINKING AGENT
CORE: EA:BA:MAA (31:23:46)(BY MOLE)
SHELL: EA:BA:MAA (21:42:37)(BY MOLE)
Neutralized with a 30% $Na_3PO_4$ + 70% $Na_2H\ PO_4$ (by weight) mixture solution. The final solution is 15% solids.

| SAMPLE EXAMPLE 74 | RATIO CORE/SHELL | % CROSSLINKING IN CORE | % CROSSLINKING IN SHELL | VISCOSITY (INITIAL) | VISCOSITY (AFTER 1 DAY) | PASTE FEEL |
|---|---|---|---|---|---|---|
| O | 4:6 | 5.0% | 1.0% | 400 cps | 4,100 cps | very good |
| P | 5:5 | 3.% | 1.0% | 1,700 cps | 5,00 cps | very good |
| Q | 5:5 | 3.% | 1.5% | 1,800 cps | 5,00 cps | good |
| R | 5:5 | 5.0% | 1.0% | 1,000 cps | 4,400 cps | very good |

Having described the invention in detail and by reference to the preferred embodiments thereof, it will be apparent that modification and variations are possible without departing from the scope of the appended claims.

What is claimed is:

1. A wallcovering material comprising a substrate having a water remoistenable adhesive on at least one of its surfaces, said adhesive comprising a composition which is a mixture of:

(1) an aqueous emulsion including an acidic polymer which is capable of swelling when in contact with an alkaline material; and (2) an alkaline material;

wherein said composition has a viscosity of less than about 10000 cps at 25° C.; wherein said composition provides adhesive properties; and wherein said alkaline material provides a buffering effect upon the acidic polymer and is selected from the group consisting of alkali metal or alkaline earth mono, di or tribasic phosphates, borates, or acetates and mixtures thereof.

2. The wallcovering material according to claim 1, wherein said substrate is selected from the group consisting of strippable wallpaper, vinyl wallpaper, peelable wallpaper, foil wallpaper, cloth fabric and silk.

3. The wallcovering material according to claim 2 wherein said acidic polymer is derived from acidic monomers including carboxylic acid or sulfonic acid groups.

4. The wallcovering material according to claim 3 wherein said acidic monomer is selected from the group consisting of acrylic acid, methacrylic acid, itaconic acid, citraconic acid, maleic acid, fumaric acid, crotonic acid, maleic anhydride, citraconic anhydride, 1-allyloxy-2-hydroxypropyl sulfonic acid, crotonic acid and 2-acrylamido-2-methylpropyl sulfonic acid and mixtures thereof.

5. The wallcovering material according to claim 3 wherein said acidic polymer is further derived from one or more nonacidic monomers.

6. The wallcovering material according to claim 5 wherein said nonacidic monomer is selected from the group consisting of alkyl acrylates or alkyl methacrylates, wherein alkyl represents an alkyl group containing between 1 and 20 carbon atoms, styrene, vinyl acetate, ethylene, butadiene, acrylamide, acrylonitrile, alkyl- or dihalo-substituted styrene, vinyl halides, vinylidene halides and mixtures thereof.

7. The wallcovering material according to claim 6 wherein the acidic monomer comprises between about 20 and about 50 weight percent of said monomers used to form said acidic polymer.

8. The wallcovering material according to claim 3 wherein said polymer is further derived from one or more surface active monomers.

9. The wallcovering material according to claim 4 wherein said acidic monomer is selected from the group consisting of acrylic acid, methacrylic acid and mixtures thereof.

10. The wallcovering material according to claim 6 wherein said nonionic monomer is selected from the group consisting of alkyl acrylates or alkyl methacrylates, wherein alkyl represents an alkyl group containing between 1 and 20 carbon atoms and mixtures thereof.

11. The wallcovering material according to claim 8 wherein said surface active monomer is selected from the group consisting of behenyl methacrylate, lauryl methacrylate, tristyryl phenol polyethylene oxymethacrylate and stearyl methacrylate.

12. The wallcovering material according to claim 1 wherein the glass transition temperature of said polymer is between about −20° C. and about 40° C.

13. The wallcovering material according to claim 1 wherein said alkaline material is selected from the group consisting of alkali metal or alkaline earth mono, di or tribasic phosphates and mixtures thereof.

14. The wallcovering material according to claim 1 wherein said adhesive composition has a viscosity of between about 100 and about 5000 cps.

15. The wallcovering material according to claim 14 wherein the overall percentage of solids in said adhesive composition is between about 5 and about 30 percent.

16. The wallcovering material according to claim 1 wherein said adhesive composition maintains a viscosity of less than 10000 centipoises for greater than seven days.

17. The wallcovering material according to claim 2 wherein the coating weight of said adhesive composition ranges from about 2 to about 20 grams/meter$^2$.

18. The wallcovering material according to claim 17 wherein the coating weight of said adhesive composition ranges from about 4 to about 10 grams/meter$^2$.

19. The wallcovering material according to claim 2 wherein the adhesive composition forms a thin coating upon wetting.

20. A wallcovering material comprising a substrate having a water remoistenable adhesive on at least one of its surfaces, said adhesive comprising a composition consisting essentially of the mixture of:

(1) an aqueous emulsion including an acidic polymer which is derived from monomers comprising (a) acrylic acid or methacrylic acid; and (b) one or more alkyl acrylates wherein alkyl represents a group containing between 1 and 20 carbon atoms; and (2) an alkaline material comprising alkali or alkaline earth metal salts of mono-, di- or tribasic phosphates and mixtures thereof;

wherein said composition has a viscosity of less than about 10000 cps at 25° C.: wherein said composition provides adhesive properties; and wherein said alkaline material provides a buffering effect upon the acidic polymer.

* * * * *